US005232894A

United States Patent [19]

Chosa

[11] Patent Number: 5,232,894

[45] Date of Patent: Aug. 3, 1993

[54] THERMAL TRANSFER RECORDING MEDIUM

[75] Inventor: Yosei Chosa, Saitama, Japan

[73] Assignee: Toppan Printing Company, Ltd., Tokyo, Japan

[21] Appl. No.: 820,974

[22] Filed: Jan. 15, 1992

[30] Foreign Application Priority Data

Jan. 16, 1991 [JP] Japan ..... 3-015769

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914, 507; 503/227

[56] References Cited

U.S. PATENT DOCUMENTS 4,650,494 3/1987 Kutsukake et al. ..... 8/471
4,720,480 1/1988 Ito et al. ..... 503/227

FOREIGN PATENT DOCUMENTS 0141678 5/1985 European Pat. Off. ..... 503/227
0399690 11/1990 European Pat. Off. ..... 503/227
59-199295A 11/1984 Japan ..... 503/227
60-183189A 9/1985 Japan ..... 503/227
61-94794A 5/1986 Japan ..... 503/227
2-233293A 9/1990 Japan ..... 503/227

*Primary Examiner*—B. Hamilton Hess
*Attorney, Agent, or Firm*—Staas & Halsey

[57] ABSTRACT

A thermal transfer recording medium comprises a substrate and, laminated thereto, an ink layer containing a sublimation dye and a binder resin. The binder resin comprises (a) from 60 to 90% by weight of polyvinyl butyral with a degree of polymerization of from 1,500 to 2,500 and a glass transition point of not lower than 70° C., and (b) from 10 to 40% by weight of ethyl cellulose with a glass transition point of not lower than 130° C.

3 Claims, 1 Drawing Sheet

THERMAL TRANSFER RECORDING MEDIUM

BACKGROUND OF THE INVENTION

1. Field of the Invention

This invention relates to a thermal transfer recording medium. More particularly, the present invention relates to a thermal transfer recording medium for recording an image on a transfer medium (or image-receiving medium) such as paper, using a thermal head.

2. Description of the Related Art

Conventional methods of recording color images make use of a printing system such as offset printing and, in addition thereto, an ink-jet recording system, an electrostatic toner recording system or a thermal transfer recording system. In particular, the thermal transfer recording system can make compact an apparatus in which it is to be used and requires only simple maintenance. Hence, this system is widely used. In particular, a system making use of a sublimation dye (hereinafter "sublimation transfer system") can provide an image with an excellent gradation and is suitable for instances in which images are recorded in full colors.

In such a sublimation transfer system, recording mediums used are exemplified by those comprised of a lamination of a heat-resistant sliding layer, a substrate film and an ink layer comprising a sublimation dye and a binder resin, and transfer mediums used are those comprised of a substrate such as paper or plastic film and laminated thereto with a dyeable resin layer. Such transfer medium and thermal transfer recording medium are brought into pressure contact at the interface between a thermal head and a platen roll, and heat corresponding with image signals is applied to that interface from the thermal head, so that a transferred image is formed.

In conventional thermal transfer recording mediums, however, the sublimation dye contained in the ink layer causes a phenomenon of agglomeration and with time, gives a phenomenon of bleeding to the surface of the ink layer. This has tended to cause adhesion of the sublimation dye also to non-image areas of the transfer medium when transfer images are formed, and what is called background staining occurs, resulting in a serious lowering of image quality.

In order to prevent such phenomenons, it has been hitherto proposed to use as a binder in the ink layer a binder composition containing 90% by weight or more of polyvinyl butylal having a molecular weight of from 60,000 to 200,000 (Japanese Patent Application Laid-open No. 60-101087).

Such polyvinyl butyral, however, has so poor a fluidity that an ink making use of a binder resin containing it in an amount of 90% by weight or more lacks desired coating properties. In instances in which such an ink is applied to a substrate sheet to prepare a thermal transfer recording medium, coating uneveness may occur to cause what is called pinholes in the ink layer of the thermal transfer recording medium. Thus, there has been the problem that image qualities such as resolution are lowered when images are formed using a thermal transfer recording medium in which such pinholes are present.

SUMMARY OF THE INVENTION

The present invention was made in order to solve the above problems in the prior art. An object of the present invention is to provide, in the sublimation transfer system, a thermal transfer recording medium that can be free of the dye agglomeration or bleeding and also does not cause any faulty transfer such as background staining even after storage for a long period time.

The present inventor has discovered that the above object of the present invention can be achieved when a composition containing polyvinyl butyral and ethyl cellulose, which have specific properties and are used in a specific proportion, is employed as a binder resin used in an ink layer, and thus has accomplished the present invention.

The present invention provides a thermal transfer recording medium comprising a substrate and, laminated thereto, an ink layer containing a sublimation dye and a binder resin, wherein said binder resin comprises (a) from 60% by weight to less than 90% by weight of polyvinyl butyral with a degree of polymerization of from 1,500 to 2,500 and a glass transition point of not lower than 70° C., and (b) from 10% by weight to 40% by weight of ethyl cellulose with a glass transition point of not lower than 130° C.

DETAILED DESCRIPTION OF THE INVENTION

Figure 1:
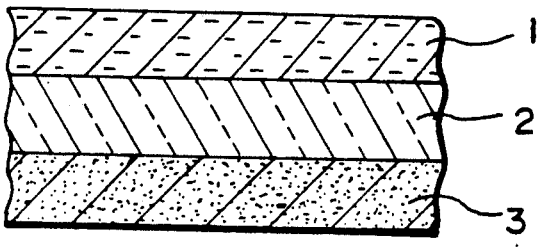
FIG. 1 is a cross-sectional illustration of an embodiment of the thermal transfer recording medium of the present invention.

The thermal transfer recording medium of the present invention will be described below in detail with reference to the accompanying drawing.

FIG. 1 cross-sectionally illustrates a thermal transfer recording medium according to a preferred embodiment of the present invention. In the embodiment shown in the drawing, an ink layer 1 is provided on a substrate 2, and a heat-resistant sliding layer 3 is provided on the surface of the substrate 2 on its side opposite to the side on which the ink layer 1 is provided.

The ink layer 1 contains a binder resin and a sublimation dye. The binder resin used in the present invention contains polyvinyl butyral and ethyl cellulose of specific types.

More specifically, the polyvinyl butyral used in the present invention has a degree of polymerization of from 1,500 to 2,500, preferably from 1,600 to 2,400, and more preferably from 1,700 to 2,400, and a glass transition point of not lower than 70° C., and preferably not lower than 80° C.

A polyvinyl butyral with a degree of polymerization less than 1,500 may give an excessively low transfer density and one with a degree of polymerization more than 2,500 may result in excessively low coating properties.

An increase in the degree of polymerization of polyvinyl butyral makes molecules of polyvinyl butyral so large that their entanglement becomes coarse. This may bring about a weak retention of sublimation properties and tend to cause ready sublimation of the sublimation dye. As a result, a higher degree of polymerization tends to bring about a higher transfer density. An excessively high degree of polymerization, however, makes the resin itself hard, resulting in a lowering of coating properties. On the other hand, a polyvinyl butyral with a low degree of polymerization can bring about an improvement in the coating properties, but may increase the power to retain the dye, tending to result in a decrease in the transfer density. That is, the degree of polymerization of polyvinyl butyral and the transfer density positively correlate with each other and, on the other hand, the degree of polymerization and the coating properties negatively correlate with each other. Thus, taking account of the conflicting tendency the degree of polymerization of polyvinyl butyral gives to the transfer density and coating properties, it is necessary to select the polyvinyl butyral used from those having properties within the above ranges.

When transfer recording is carried out, the thermal transfer recording medium is heated to 200° C. or above in a short time, and hence there is a possibility that the ink layer 1 melt-adheres to the transfer medium if the binder resin of the ink layer 1 has a low glass transition point. Accordingly, it is necessary to use polyvinyl butyral having a glass transition point of not lower than 70° C.

In the present invention, the binder resin comprises the polyvinyl butyral as described above, in addition to which an ethyl cellulose with a glass transition point of not lower than 130° C., and preferably not lower than 145° C., is used in combination. Use of only the above polyvinyl butyral without use of such an ethyl cellulose may make low the fluidity of the binder resin and bring about poor coating properties, which makes it impossible to obtain a uniform coating surface. Use of the ethyl cellulose having a compatibility with the polyvinyl butyral and a glass transition point of not lower than 130° C. makes it possible to improve the coating properties of the binder resin to give a uniform coating surface, and also makes it possible to improve the thermal resistance of the thermal transfer recording medium. However, incorporation of the ethyl cellulose in excess may cause faulty transfer such as background staining because of a poor dye retention inherent in the ethyl cellulose. Accordingly, the binder resin used in the present invention is composed in such a proportion that the polyvinyl butyral is in an amount of from 60% by weight to less than 90% by weight, preferably from 70% by weight to 85% by weight, and more preferably 80% by weight, and the ethyl cellulose is in an amount of from 10% by weight to 40% by weight, preferably from 15% by weight to 30% by weight, and more preferably 20% by weight.

As the sublimation dye used in the ink layer 1, commonly used sublimation dyes can be widely used, as exemplified by those of a diarylmethane type, a triarylmethane type, a thiazole type, a methine type, an azomethane type, a xanthene type, an oxazine type, a thiazine type, an azine type, an acridine type, an azo type, a spirodipyran type, an indolynospirodipyran type, a fluorane type, a Rhodamine type or an anthraquinone type.

The ink layer 1 may also be appropriately incorporated with various additives such as pigments, surface active agents, softening agents, and substances capable of absorbing electromagnetic waves to liberate heat.

The mixing proportion of the sublimation dye and binder resin that constitute the ink layer 1 may vary depending on the type of dyes, composition of binder resin, heating temperature during thermal transfer, heating time therefor, etc. In usual instances, they may be mixed in such a proportion that the sublimation dye is in an amount of from 1 to 15% by weight, and preferably from 3 to 10% by weight, and the binder resin is in an amount of from 2 to 20% by weight, and preferably from 5 to 15% by weight.

The ink layer 1 may preferably have a layer thickness of from 0.1 to 3.0 μm, and more preferably from 0.3 to 1.5 μm.

The substrate 2 used in the present invention may include substrates commonly used in thermal transfer recording mediums, as exemplified by plastic films such as polyester films, polystyrene films, polysulfone films, polyimide films, polyvinyl alcohol films, aromatic polyamide films and aramid films, or thin paper sheets such as cellophane and condensor paper, which can be appropriately used according to the purpose.

The substrate 2 may preferably have a thickness of from 3.5 to 12.0 μm, and more preferably from 4.5 to 9.0 μm.

The substrate 2 may also be appropriately provided, on its side on which the ink layer 1 is not formed, with a heat-resistant sliding layer 3 as shown in FIG. 1, if necessary for the purpose of preventing the substrate 2 from melt-adhering to a thermal head. Such a heat-resistant sliding layer 3 can be formed utilizing silicone mixtures or silicone-modified products of resins such as acrylic resins, urethane resins, cellulose resins, epoxy resins, and silicone resins. The heat-resistant sliding layer 3 may preferably have a thickness of from 0.1 to 1.5 μm, and more preferably from 0.1 to 0.8 μm.

The thermal transfer recording medium of the present invention can be produced by conventional methods. For example, an ink comprising the sublimation dye, the binder resin and a solvent is coated on the surface of the substrate 2 by means of a gravure coater or the like, followed by drying to form the ink layer 1, and a composition for the heat-resistant sliding layer is coated on the surface of the substrate 2 opposite the surface on which the ink layer 1 has not been formed, followed by drying to form the heat-resistant sliding layer 3. Thus, the thermal transfer recording medium of the present invention can be produced.

The thermal transfer recording medium of the present invention can be applied not only in recording apparatus in which a thermal head is used as a heating means for transfer, but also in recording apparatus in which infrared rays or laser beams are used as the heating means.

The binder resin that contitutes the ink layer of the thermal transfer recording medium according to the present invention is comprised of the polyvinyl butyral and ethyl cellulose having the specific properties and used in the specific proportion, and hence has superior coating properties, so that the ink layer of the thermal transfer recording medium according to the present inventin can have an even, uniform coating surface. Moreover, the thermal transfer recording medium of the present invention can be free from the phenomenon of agglomeration or bleeding of the sublimation dye even after storage for a long period of time, and also enables image recording free from faulty transfer such as background staining.

EXAMPLES

The present invention will be more specifically described below. In the following Examples "part(s)" refers to "part(s) by weight".

Examples 1 to 3, Comparative Examples 1 to 5

On a polyester film with a thickness of 5.7 μm (LUMIRROR 6CF53; trade name; available from Toray Industries, Inc.), the compositions formulated as shown in Table 1 were each coated in a dried coating weight of 1.0 g/m² using a gravure coater. On the back surface thereof, a composition comprised of 5 parts of acrylic resin (BR85; available from Mitsubishi Rayon Co., Ltd.), 1 part of silicone oil (KP360; available from Shin-Etsu Chemical Co., Ltd.) and 94 parts of toluene was further coated in a dried coating weight of 1.0 g/m² using a bar coater, followed by drying to provide a heat-resistant sliding layer. Thermal transfer recording mediums were thus obtained.

The resulting thermal transfer recording mediums were each set on a video printer GZ-21, manufactured by Sharp Corp., and a video image was transferred to a commonly available transfer medium having a dyeable layer comprising an ester resin, at an energy of 1.0 mJ/dot. Examinations were made on the following items.

Transfer Density

Using Macbeth RD918, the transfer density of each transferred image was measured. Results obtained are shown in Table 2.

Coating Surface

The state of the coating surface of each ink layer was visually examined. Results obtained are shown in Table 2. In the table, "A" indicates an instance where no uneveness occurs in the transferred image; "B", an instance where uneveness slightly occurs in the transferred image; and "C", an instance where uneveness occurs in the transferred image and the medium is untolerable for practical use.

Background Staining

Visual observation was made on how the dye has adhered to the marginal white frame, what is called the white background, of each transfer medium to which the video image has been transferred. Results obtained are shown in Table 2. In the table, "A" indicates an instance where no background staining occurs; "B", an instance where no background staining slightly occurs; and "C", an instance where background staining occurs and the medium is untolerable for practical use.

Melt-adhesion of Ink Layer

During the operation of thermal transfer, visual observation was made on whether or not the ink layer has melt-adhered to the transfer medium. Results obtained are shown in Table 2. In the table, "A" indicates an instance where no melt-adhesion occurs during transfer; and "C", an instance where melt-adhesion occurs.

TABLE 1

| | Polyvinyl butyral | Ethyl cellulose | Dye | Solvent |
|---|---|---|---|---|
| Example: | | | | |
| 1 | 8 parts | 2 parts | 10 parts | 80 parts |
| 2 | 6 parts | 4 parts | 10 parts | 80 parts |
| 3 | 8 parts | 2 parts | 10 parts | 80 parts |
| Comparative Example: | | | | |
| 1 | 9.5 parts | 0.5 part | 10 parts | 80 parts |
| 2 | 9 parts | 1 part | 10 parts | 80 parts |
| 3 | 5 parts | 5 part | 10 parts | 80 parts |
| 4 | 8 parts | 2 part | 10 parts | 80 parts |
| 5 | 8 parts | 2 part | 10 parts | 80 parts |

As the polyvinyl butyral, in Examples 1 and 2 and Comparative Examples 1 to 3, S-LEC BZ-1 (trade name; degree of polymerization: 1,700; glass transition point: 85.5° C.), available from Sekisui Chemical Co., Ltd., was used. In Example 3, 6000EP (degree of polymerization: 2,400; glass transition point: 89° C.), available from Denki Kagaku Kogyo Kabushiki Kaisha, was used. In Comparative Example 4, S-LEC BH-3 (trade name; degree of polymerization: 1,700; glass transition point: 63.3° C.), available from Sekisui Chemical Co., Ltd., was used. In Comparative Example 5, S-LEC BH-S (trade name; degree of polymerization: 1,000; glass transition point: 58° C.), available from Sekisui Chemical Co., Ltd., was used.

As for the ethyl cellulose, in Examples 1 to 3 and Comparative Examples 1 to 5, N-7 (glass transition point: 156), available from Hercules Inc., was used. As for the dye, in Examples 1 and 2 and Comparative Examples 1 to 3, MS-Magenta-VP, available from Mitsui Toatsu Chemicals, Inc., and in Example 3 and Comparative Examples 4 and 5, Ceresblue-GN, available from Bayer AG, was used. In all of these Examples and Comparative Examples, a 1/1 mixture of toluene/methyl ethyl ketone was used as the solvent.

TABLE 2

| | Transfer density | Coating surface | Background staining | Melt-adhesion |
|---|---|---|---|---|
| Example: | | | | |
| 1 | 1.8 | A | A | A |
| 2 | 1.9 | A | B | A |
| 3 | 1.8 | A | A | A |
| Comparative Example: | | | | |
| 1 | 1.8 | C | A | A |
| 2 | 1.8 | B | A | A |
| 3 | 1.9 | A | C | A |
| 4 | 1.6 | A | A | C |
| 5 | 1.4 | A | A | C |

As described above, the recording medium of the present invention can be free from the phenomenon of bleeding of the sublimation dye even after storage for a long period of time, can also be free from background staining, melt-adhesion of the ink layer 1 to the transfer medium and faulty transfer caused by coating uneveness of the ink layer, and can obtain superior transferred images with a high transfer density.

What is claimed is:

1. A thermal transfer recording medium comprising a substrate and, laminated thereto, an ink layer containing a sublimation dye and a binder resin, wherein said binder resin comprises (a) from 60% by weight to less than 90% by weight of polyvinyl butyral with a degree of polymerization of from 1,500 to 2,500 and a glass transition point of not lower than 70° C., and (b) from greater than 10% by weight to 40% by weight of ethyl cellulose with a glass transition point of not lower than 130° C.

2. A thermal transfer recording medium comprising a substrate and, laminated thereto, an ink layer containing a sublimation dye and a binder resin, wherein said binder resin comprises (a) from 70% by weight to less 85% by weight of polyvinyl butyral with a degree of polymerization of from 1,500 to 2,500 and a glass transition point of not lower than 70° C., and (b) from 15% by weight to 30% by weight of ethyl cellulose with a glass transition point of not lower than 130° C.

3. The thermal transfer recording medium according to claim 2, wherein said binder resin comprises (a) 80% by weight of polyvinyl butyral with a degree of polymerization of from 1,500 to 2,500 and a glass transition point of not lower than 70° C., and (b) 20% by weight of ethyl cellulose with a glass transition point of not lower than 130° C.

* * * * *